United States Patent [19]

Lynn

[11] Patent Number: 4,474,732

[45] Date of Patent: Oct. 2, 1984

[54] FULLY DENSE WEAR RESISTANT ALLOY

[75] Inventor: Jean C. Lynn, Elmhurst, Ill.

[73] Assignee: Amsted Industries Incorporated, Chicago, Ill.

[21] Appl. No.: 87,728

[22] Filed: Oct. 24, 1979

Related U.S. Application Data

[62] Division of Ser. No. 019,502, Mar. 12, 1979, abandoned.

[51] Int. Cl.[3] ..... B22F 3/16

[52] U.S. Cl. ..... 419/11; 419/30; 75/243

[58] Field of Search ..... 75/200, 201, 203, 211; 419/1, 10, 14, 15, 30, 11

[56] References Cited

U.S. PATENT DOCUMENTS 3,591,349 7/1971 Benjamin ..... 75/243
4,035,159 7/1977 Hashimoto et al. ..... 75/201
4,106,931 8/1978 Nayar ..... 75/201
4,121,927 10/1978 Lohman et al. ..... 75/213

FOREIGN PATENT DOCUMENTS 48-31803 2/1973 Japan ..... 75/243

*Primary Examiner*—Benjamin R. Padgett
*Assistant Examiner*—Anne Brookes
*Attorney, Agent, or Firm*—Fred P. Kostka; Charles E. Bouton

[57] ABSTRACT

An alloy steel is provided along with a method of making the same. The alloy is heat, wear, corrosion and oxidation resistant, and is preferably made utilizing powder metallurgy techniques. The method involves the addition of carbon and silicon to an iron base alloy containing chromium to improve the properties of the steel.

5 Claims, No Drawings

FULLY DENSE WEAR RESISTANT ALLOY

This is a division of application Ser. No. 19,502, filed Mar. 12, 1979, now abandoned.

BACKGROUND OF THE INVENTION

The present invention generally relates to providing an alloy steel having improved wear, heat, corrosion and oxidation resistant characteristics, and more specifically, to an alloy steel having carbon, silicon and chromium added thereto. The particular alloy is especially useful in the manufacture of internal combustion engine parts, particularly valve seat inserts. The method of producing the alloy is especially adapted to powder metallurgy techniques, but the alloy may be produced by foundry casting techniques.

It is known in the powder metallurgy art to add natural graphite as a carbon source to pure iron or low alloy, low carbon steel powders to modify the properties of the sintered steel parts. Such disclosure is contained in U.S. Pat. No. 4,121,927, assigned to the assignee of the present invention. It is further known to add natural graphite as a carbon source to high alloy or stainless steel powders to increase the wear resistance of the sintered steel parts. The type 440 stainless steels, the tool steels, valve alloys and the wear resistant materials contain carbides that contribute to the properties of the metals. However, the presence of such carbides even in small quantities in the as atomized powder significantly reduces the compressibility and green strength of the metal powder and requires annealing prior to compaction. In fact, as the amount of carbides in the as atomized powder increases, the compressibility and green strength decrease rapidly. In addition, it has been found that increased amounts of silicon in the molten steel prior to atomization cause a severe reduction in compressibility and green strength of the resulting powder.

To provide improved compressibility and green strength of the metal powder, it is part of the present invention to add silicon powder to a metal powder which had a reduced silicon content when atomized. As the present invention also relates to an alloy steel produced by foundry casting methods, the increasing of the silicon content of a molten metal alloy is also considered part of the present invention.

Accordingly, it is an object of the present invention to provide an alloy steel having improved wear, heat, corrosion and oxidation resistance.

SUMMARY OF THE INVENTION

The present invention provides a heat, wear, corrosion and oxidation resistant, high alloy steel. One method of producing the alloy is to use powder metallurgy techniques. It is also possible to produce the alloy by foundry casting techniques. The alloy of the present invention has a final essential composition of 4–8% silicon, 12–19% chromium, 1–2.5% carbon, and the balance essentially iron.

DETAILED DESCRIPTION

The production of a fully dense, alloy product is seen in the following examples.

EXAMPLE 1

One iron base alloy that was water atomized and screened to provide a −88 mesh powdered metal had the following initial analysis by weight:

Chromium: About 17%
Manganese: About 1.3%
Carbon: About 0.08%
Silicon: About 1%
Iron: Essentially balance The powdered metal was blended with 1.3% by weight of powdered natural graphite, and 4.0% by weight fine silicon powder to achieve the desired elevated carbon and silicon contents. In addition 1.0% by weight Acrawax C® was added for die lubrication purposes. Any similar lubricant may also be used. The sample was compacted in a die at 50 TSI (7047 Kg/cm$^2$), the lubricant was removed in a burn off process and the powder blank was then vacuum sintered at 2200° F. (1204° C.) for one hour. A final heat, wear and oxidation resistant product having a density of 99% of theoretical was produced.

EXAMPLE 2

Another iron base alloy was water atomized and screened to provide a −88 mesh powdered metal that had the following analysis by weight:

Chromium: About 17%
Manganese: About 1.3%
Carbon: About 0.08%
Silicon: About 3.5%
Iron: Essentially balance The powdered metal was blended with 1.3% by weight of powdered natural graphite and 3.0% by weight of silicon powder to achieve the desired elevated carbon and silicon contents. In addition, 1.0% by weight Acrawax C® was added for die lubrication purposes. Any similar lubricant may also be used. This sample was compacted in a die at 50 TSI (7047 Kg/cm$^2$), the lubricant was removed in a burn off process, and the powder blank so formed was vacuum sintered at 2140° F. (1171° C.) for one hour. A final heat, oxidation and wear resistant product having a density of 99% of theoretical was produced.

In other examples, sintering was performed at similar temperatures for a few minutes to a few hours, with similar full density products resulting.

EXAMPLE 3

Another iron base alloy that was prepared by foundry techniques had the following initial analysis by weight:

Chromium: About 16%
Manganese: About 1.3%
Silicon: About 6.5%
Carbon: About 1.3%
Iron: Essentially balance The sample was melted in an induction furnace and cast into a sand mold at a casting temperature of about 2500° F. (1371° C.). The resultant microstructure was free from excessive porosity and had properties similar to the previous two examples.

It will be understood that other samples of various initial analysis within the limits set forth in the following claims should be considered part of the present invention, as final products can be successfully produced from them by the methods of the present invention.

I claim:

1. A method of producing a high density, heat, wear, corrosion and oxidation resistant, iron base material including the steps of: providing an alloy powder consisting essentially of, by weight, 1.0–2.5% carbon, 12–19% chromium, 4–8% silicon and the balance essentially iron, compacting said alloy powder and sintering said compacted alloy powder at 2100°-2450° F. (1150°-1343° C.) for a time sufficient to form a fully dense alloy.

2. A method of producing a high density, heat, wear, corrosion and oxidation resistant, iron base material including the steps of:

providing an alloy consisting essentially of, by weight, up to about 0.2% carbon, 12-19% chromium, about 1.3% manganese, 0.5-3.5% silicon and the balance essentially iron, water atomizing and screening said alloy to form a powder metal, adding 1.0-2.5% by weight carbon and 0.5-4.5% by weight silicon containing powder to provide a final silicon content of 4-8%, compacting said alloy powder and sintering said compacted powder at 2100°-2450° F. (1150°-1343° C.) for a time sufficient to form a fully dense alloy.

3. The method of claim 1 or 2, where said sintering takes place for about one hour.

4. The method of claim 1 or 2, where said sintering takes place in a near vacuum.

5. The method of claim 1 or 2, where said compacting is done at about 50 TSI (7045 Kg/cm$^2$).

* * * * *